US005486135A

United States Patent [19]

Arpaio

[11] Patent Number: 5,486,135

[45] Date of Patent: Jan. 23, 1996

[54] VIBRATORY TUMBLING MACHINE VESSEL FOR BURNISHING OR CLEANSING METAL, PLASTIC OR CERAMIC ELEMENTS

[76] Inventor: Jerry Arpaio, 72 Heller Hill Rd., Blairstown, N.J. 07825

[21] Appl. No.: 332,141

[22] Filed: Oct. 31, 1994

[51] Int. Cl.[6] ..... B24B 31/00

[52] U.S. Cl. ..... 451/326; 451/328; 451/329

[58] Field of Search ..... 451/526–530, 451/104, 113, 326, 329, 328; 220/4.25

[56] References Cited

U.S. PATENT DOCUMENTS

| | | | |
|---|---|---|---|
| 29,220 | 5/1877 | Rampe | 451/326 |
| 2,476,078 | 7/1949 | Banks | 451/328 |
| 2,924,914 | 2/1960 | Garwood | 451/328 |
| 3,513,604 | 5/1970 | Matsunaga et al. | 451/32 |
| 3,680,266 | 8/1972 | Shiplou | 451/326 |
| 3,813,816 | 6/1974 | Funk | 451/113 |
| 4,021,971 | 5/1977 | McFadden | 451/328 |
| 4,571,963 | 2/1986 | Williams | 451/113 |

FOREIGN PATENT DOCUMENTS

| | | | |
|---|---|---|---|
| 1371240 | 7/1964 | France | 220/4.25 |
| 7114357 | 7/1982 | Japan | 451/327 |
| 4193467 | 7/1992 | Japan | 451/328 |
| 6008131 | 1/1994 | Japan | 451/328 |
| 1348152 | 10/1987 | U.S.S.R. | 451/326 |
| 1359098 | 12/1987 | U.S.S.R. | 451/326 |
| 4129662 | 4/1992 | U.S.S.R. | 451/328 |
| 1743819 | 6/1992 | U.S.S.R. | 451/326 |
| 1771926 | 10/1992 | U.S.S.R. | 451/328 |

*Primary Examiner*—Bruce M. Kisliuk
*Assistant Examiner*—Derris Banks
*Attorney, Agent, or Firm*—William T. Hough

[57] ABSTRACT

Accressory burnishing-treatment apparatus for treatment, namely deburring, turning corners, polishing or cleaning of elements, namely metal, plastic, or ceramic (typically glass) elements. The apparatus is a self-contained hollow sphere, preferably made from substantially abrasion-resistant plastic, that works in conjunction with typically any traditional vibratory tumbling machine. The apparatus preferably has a screw-in port lid or closure member which opens to spherical inner space allowing insertion and later removal from the spherical inner space each of elements after treatment thereof, and removal of that was media necessary for the treatment. Liquid and/or dry or wet media may be used with the elements in combination. The self-contained hollow sphere together with any media and abrasive(s) and elements to be treated, locked therein by its male closure member, is placed into media and abrasives or the like contained for treatment by a vibratory tumbling machine where when activated, when the vibrations and tumbling action of the vibratory tumbling machine transfers its vibrations and movement to the closed sphere and its contents such that the treatment of elements within the sphere is accomplished on the isolated elements within the spherical inner space.

34 Claims, 4 Drawing Sheets

FIG. 1A
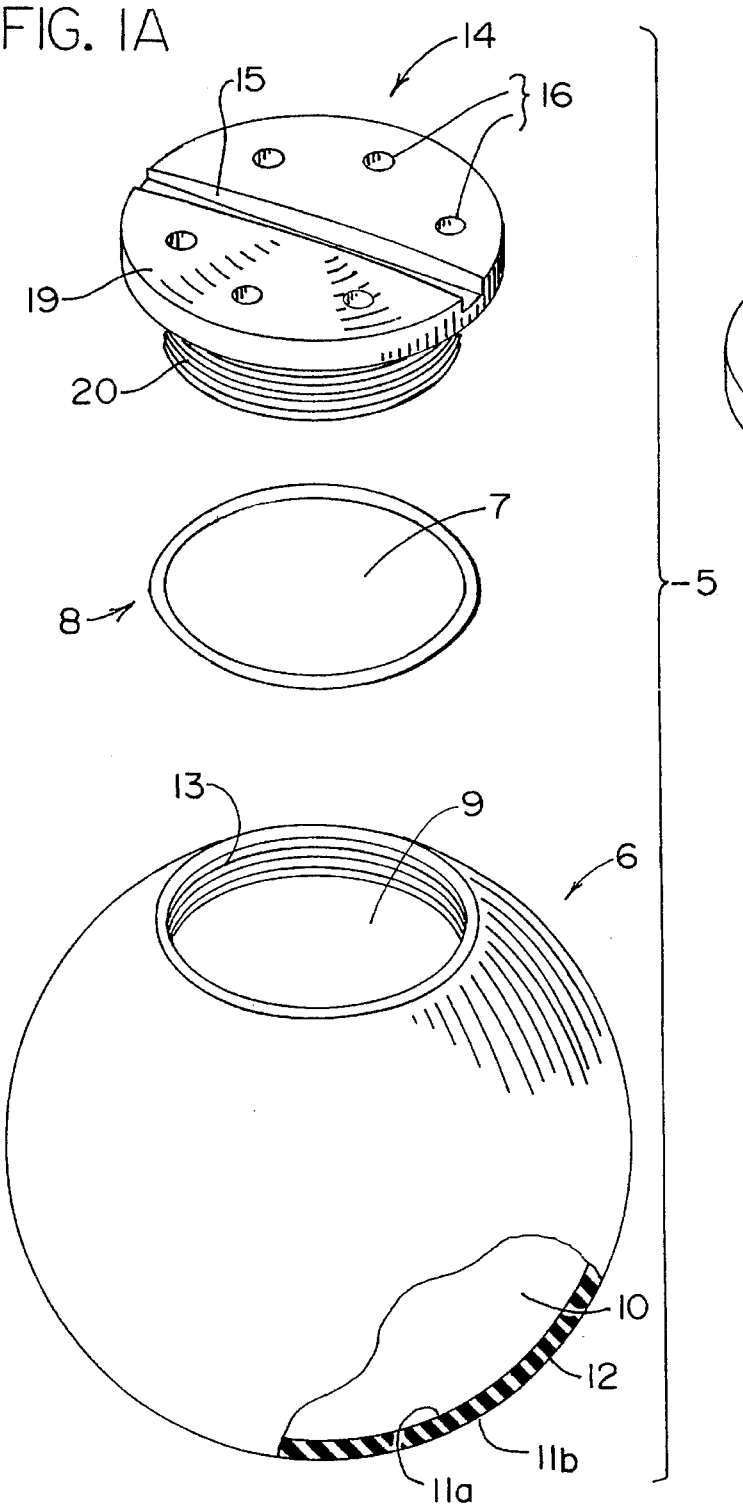
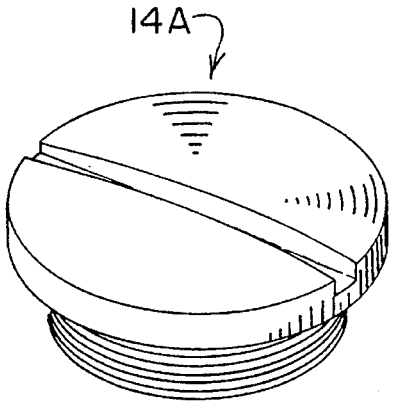
FIG. 1B

VIBRATORY TUMBLING MACHINE VESSEL FOR BURNISHING OR CLEANSING METAL, PLASTIC OR CERAMIC ELEMENTS

This invention relates to a vibratory vessel for burnishing or cleansing elements, for use in conjuntion with a vibratory tumbling machine, but with the vessel-contained elements isolated from other elements being treated concurrently by the vibratory tumbling machine.

PRIOR ART

Prior to the filing of a patent application, a professional novelty search was conducted in the United States Patent & Trademark Office patent Class 51, subclasses 163.1, 313, 164.1 and 317 thereof. While no truly relevant prior art was located, typically the following prior art patents of interest were located. Funk U.S. Pat. No. 1,313,816 and McFadden U.S. Pat. No. 4,021,971 and Banks U.S. Pat. No. 2,476,078 and Mashahisa Matsunaga et al U.S. Pat. No. 3,513,604 each and all show use of separate tumblers of tumbling machines utilizzing abrasive aggregates. The McFadden patent discloses that separate drums may use separate batches of gems (to be polished) for time periods varied from other batches of other separate hollow cylinder receivers. Each of these separate self-contianed containers operates with its own independent separate liquid-carrier (slurry-liquid/if any liquid used). There were no other patents located having any discernible pertinence to the present invention.

GENERAL PRIOR ART AND BACKGROUND

The general process of mechanized burnishing, including typically burr removal and/or polishing and/or cleansing, as necessitated by the manufacturing industry, is today facilitated by use of conventional industrial tumbling machines of massive sizes produced and/or replaced solely by massive significant expenditures of capital. While such large machines are very effective in the sense of mass production, in the treatment of large size parts (elements) and/or large: sized lots (of elements) being tumbled in a selected media, they become increasing less cost-effective and less time-effective, i.e. less economical and more expensive, as the quantity and/or size of each element being so-treated is scaled downwardly (to smaller and smaller), such as eventually to the treatment of micro-sized parts (elements). While the ultimate solution might appear to be merely the production and use of a smaller scaled-down model of the conventional aforestated vibratory tumbling machine(s), as a practical cost matter such approach for such small-scale machines would contribute to just as much cost and time loss as their larger counterpart massive-sized machines. The reason is that each lot (quantity) of typically micro-sized elements (parts) has to be run separately from other differently shaped and/or different function type other lot (s) of micro-sized parts, because the task of separating any mixture thereof from others, all microscopic in size and mixed within the media, becomes an arduous and almost impossible and time-consuming and costly task, typically making loss of many microparts a fact of doing business, further adding to the cost of such overall operation, apart from the high cost of such machines in miniature. Additionally, to even approach the possibility of solving the problem, numerous such miniature machines would that have to be purchased. Also there would would be continuous wear and tear and lost time and maintenance on such miniature tumblers, and increased electricity usage demand, but also especially increased operator time, as the miniature tumbler (s) have to be emptied, sorted and cleaned between lots, to prevent contamination of future lots. Apart from down-sized tumblers, another problem in dealing with microsized elements, in the treatment thereof, whether large or small tumblers, deals with the fact that many of such small elements typically in the past, have fallen (worked their way) to the bottom, where they merely sit, being improperly abraded on less than all surfaces and/or not effectively abraded nor cleaned (nor otherwise treated) at all. Accordingly, microsized or small elements in need of treatment is a major problem area where heretofore there have been unsolved problems plaguing the industry. In my own specialized experience in this field spanning a period of over twenty years, including the use of barrel-type rotary tumblers, the process of treatment above-described was slow and cumbersome and required time-costly post-process unit clean-up(s). My experience during that period included intensive experience in a major and leading company that purchased a small bench top vibratory tumbler for the very small parts manufactured by that company, and even though the unit was only a small bench top unit, it was very expensive. Another problem with the miniature elements, apart from the problem of later having to separate differently shaped or designed elements from one another, often different elements require different treatments and/or different abrasives or the like, and often the elements are not of the same composition, such that if placed together one would contaminate the other during treatment—in many instances rendering one type or all worthless, or requiring separate subsequent cleansing thereof, a further cost factor and time factor of greater expense. Thus, far from there existing an easy or selfevident solution, there were many conflicting signals and complicating factors and problems. Ultimately, to solve the foregoing host of problems and disadvantages and difficulties, and accordingly to achieve a large number of desired objects, I created the present invention.

OBJECTS THE INVENTION

Broadly objects of the invention include the overcoming and/or avoiding problems and disadvantages and difficulties aforestated, while achieving other novel results and advantages as set-forth hereinbelow.

Another object is to avoid further or additional consumption of electricity or other power input beyond that already required by a conventional or other vibratory tumbling machine of typically the large or massive type normally employed by industry during the conventional tumbling use thereof.

Another object is to obtain a unit (or combination) that is substantially maintenance-free during one, or more or repeated uses thereof for common types of microsized elements being treated and/or in need of treatment such as aforestated burnishing or cleansing of any one of metal, plastic or ceramic elements.

Another object is to obtain a unit (or combination) free or substantially free of moving parts or any requirement therefor, apart for separate abrasive(s) and/or suspension media appropriately and/or conventionally utilized in such treatment(s).

Another object is one of environmental cleanliness against machine noise, i.e. to obtain foregoing and following objects while avoiding noise pollution of the environment beyond that already existing, while achieving the novel objects and advantages of the invention.

Another object is to obtain a treatment unit adaptable to easy and/or inexpensive cleaning.

Another object is to obtain a treatment unit utilizable with a maximum degree of ease and effectiveness devoid of potential complications.

Another object is to obtain a treatment unit having a high degree of effectiveness in achieving the aforestated treatment(s).

Another object is to achieve economy in the operation of typically conventional large massive sized vibratory and/or centrifugal tumbling machine(s), to achieve significant cost savings while achieving the treatment of micro elements aforestated.

Another object is to achieve one or more foregoing objects while proceeding with typically conventional treatment operations of non-micro elements, to thereby avoid disruption mass treatment of larger elements being treated by typically conventional treatment in the large industrial vibratory and/or centrifugal tumbling machines.

Another object is to enable concurrent identical or different treatment(s) of different micro-sized elements by virtue of the present invention.

Another object is, by use of the present inventive unit (s), to avoid difficulties and/or delays and/or costly time consumptions in removal and/or separation and/or recognition of the diffently characterized micro-sized elements.

Other elements become apparent from the preceding and following disclosure.

All of the foregoing objects are achieved by one or more of the following embodiments of the present invention.

SUMMARY OF THE INVENTION

Broadly the invention may defined as a vibratory vessel for use in conjunction with a vibratory tumbling machine utilizing a burnishing or cleansing media, for burnishing or cleansing metal, plastic and ceramic elements characterized as follows. In the broadest generic combination, there are basically two elements, namely a substantially globe-forming structure having a female closure opening to inner space thereof, and a male closure member in combination. The substantially globe-forming structure has a substantially globally-shaped exterior surface and has an inner wall surface forming a globally-shaped inner space separate and apart from outer space exterior to said globe-forming structure. The substantially globe-forming structure has at-least one female closure opening-forming structure forming at-least one female closure-opening therein. The substantially globe-forming structure is composed of a substantially continuous wall structure of a wall composition of predominantly at-least one of rubber and a plastic. There can be a plurality of the female closure opening and of the male closure member. Each one of the male closure members has a shape effective to effectively close or seal its particular matched female closure-opening. The at-least one of the female closure opening-forming structure and its matched at-least one closure member are jointly and coordinately structured such that the at-least one of said female closure: opening-forming structure is intermittently mountable within the at-least one female closure-opening. The substantially continuous wall structure is retainable within the globally-shaped inner space, of at-least one of metal, plastic and ceramic elements when the substantially spherical globe-forming structure is caused to at-least one of revolve and tumble after at-least one of metal, plastic and ceramic elements has/have been placed within the globally-shaped inner space. The female closure-opening is of a first predetermined size sufficiently large for passage therethrough at-least one of any of the metal, plastic and ceramic elements within the globally-shaped inner space.

In a first preferred embodiment as an improvement on the generic broad invention above-described, the substantially continuous wall-structure has inner walls forming the globally-shaped inner space, and the composition is of a predetermined hardness sufficient that the inner walls are substantially abrasive-resistant to abrasive action of a burnishing can position adapted to burnish or cleanse at-least one of the metal, plastic and ceramic elements when a burnishing and/or cleansing composition(s) is/are jointly enclosed within the global inner space with the at-least one or more of the metal, plastic and ceramic elements.

In a second preferred embodiment as a further improvement on the first preferred embodiment, the wall composition consists essentially of predominantly polypropylene.

In a third preferred embodiment as a further improvement on the second preferred embodiment, the wall composition consists essentially of predominantly a polypropylene copolymer.

In a fourth preferred embodiment as a further improvement on the third preferred embodiment, the wall composition consists essentially of predominantly natural rubber.

In a fifth preferred embodiment as a further improvement on the fourth preferred embodiment, the wall composition consists essentially of predominantly a synthetic rubber having aforestated characteristics.

In a sixth preferred embodiment as a further improvement on the fifth preferred embodiment, the at-least one closure member includes a male threaded structure, and the at-least one female opening-forming structure includes a female-threaded structure. The male threaded structure is sealably mateable with the female threaded structure.

In a seventh preferred embodiment as a further improvement on the sixth preferred embodiment, the substantially globally-shaped exterior surface is substantially spherical in shape.

In an eighth preferred embodiment as a further improvement on the seventh preferred embodiment, the inner wall surface is substantially spherical in shape.

In a ninth preferred embodiment as a further improvement on the sixth preferred embodiment, the substantially globally-shaped exterior surface is substantially multisided in shape.

In a tenth preferred embodiment as a further improvement on the ninth preferred embodiment, the inner wall surface is substantially multisided in shape.

In an eleventh preferred embodiment as a further improvement on the tenth preferred embodiment, each of both of the globally-shaped exterior surface and the inner wall surface, is polygonal in shape.

In a twelfth preferred embodiment as a further improvement on the eleventh preferred embodiment, the substantially continuous wall structure includes a plurality of shrill apertures extending between and through the substantially globally-shaped exterior surface. Also the substantially continuous wall structure has an inner wall surface, and each of the plurality of small apertures is of a predetermined maximum size sufficiently small to retain at-least one of metal, plastic and ceramic elements within the globally-shaped inner space.

In a thirteenth preferred embodiment as an improvement on the twelfth preferred embodiment, each of the plurality of small apertures is of a predetermined maximum size sufficiently small to retain the metal elements within the globally-shaped inner space.

In a fourteenth preferred embodiment as a further improvement on the twelfth preferred embodiment, each of the plurality of small apertures is of a predetermined maximum size sufficiently small to retain the plastic elements within the globally-shaped inner space.

In a fifteenth preferred embodiment as an improvement on the twelfth preferred embodiment, each of the plurality of small apertures is of a predetermined maximum size sufficiently small to retain the ceramic elements within the globally-shaped inner space.

In a sixteenth preferred embodiment as an improvement on the twelfth preferred embodiment, the at least one closure member includes a lip structure overhanging the male threaded structure. Additionally there is included a sealing ring mounted around the male threaded structure whereby the male threaded structure is sealably mounted in the female threaded structure.

In a seventeenth preferred embodiment as an improvement on the eleventh preferred embodiment, each closure member includes the same improvement as the sixteenth preferred embodiment.

In an eighteenth preferred embodiment as a further improvement on the eleventh preferred embodiment, there are included a plurality of the substantially globe-forming structures and of their respective male closure members sealable into their matched female closure opening thereof. Additionally, each of the plurality has a different visibly discernibly recognizable identity thereon different from identities of each of remaining others of the plurality of also different identities.

In a ninteenth preferred embodiment as a further improvement on the eighteenth preferred embodiment, each of the plurality has a different color marking as compared to a remainder of others of the plurality.

In a twentieth preferred embodiment as a further improvement on the eleventh preferred embodiment, there is/are included abrasive element (s) within the globally-shaped inner space. The abrasive elements are each of a second predetermined size sufficiently small for passage through the female closure-opening.

In a twenty-first preferred embodiment as a further improvement on the eleventh preferred embodiment, the abrasive element(s) include(s) predominantly at-least one of plastic elements, ceramic elements, crushed walnut shells, corn cob dust, steel shot and stone aggregates.

In a twenty-second preferred embodiment, as a further improvement on the eleventh preferred embodiment, the abrasive material includes predominantly plastic elements.

In a twenty-third preferred embodiment as an improvement on the eleventh preferred embodiment, there is included suspension media at-least partially suspendable of at-least one of the abrasive material and the metal, plastic and ceramic elements within the globally-shaped inner space when the substantially globe-forming structure with the at-least one male closure member sealably mounted within the at-least one female closure-opening, is tumbled by a vibratory tumbling machine.

In a twenty-fourth preferred embodiment as an improvement on the broad invention, there is the same improvement as the sixth preferred embodiment.

In a twenty-fifth preferred embodiment as an improvement on the broad invention, there is the same improvement as the eighth preferred embodiment.

In a twenty-sixth preferred embodiment as an improvement on the broad invention, there is the same improvement as the ninth preferred embodiment.

In a twenty-seventh preferred embodiment as an improvement on the broad invention, there is the same improvement as the tenth preferred embodiment.

In a twenty-eighth preferred embodiment as an movement on the broad invention, there is the same improvement as the eleventh preferred embodiment.

In a twenty-ninth preferred embodiment as an improvement on the broad invention, there is the same improvement as the twelfth preferred embodiment.

In a thirtieth preferred embodiment as an improvement on the broad invention, there is the same improvement as the thirteenth preferred embodiment.

In a thirty-first preferred embodiment as an improvement on the broad invention, there is the same improvement as the fourteenth preferred embodiment.

In a thirty-second preferred embodiment as an improvement on the broad invention, there is the same improvement as the fifteenth preferred embodiment.

In a thirty-third preferred embodiment as an improvement on the broad invention, there is the same improvement as the sixteenth preferred embodiment.

In a thirty-fourth preferred embodiment as an improvement on the broad invention, there is the se improvement as the seventeenth preferred embodiment.

In a thirty-fifth preferred embodiment as an improvement on the broad invention, there is the same improvement as the eighteenth preferred embodiment.

In a thirty-sixth preferred embodiment as an improvement on the thirty-fifth preferred embodiment, there is the same improvement as the nineteenth preferred embodiments.

In a thirty-seventh preferred embodiment as an improvement on the broad invention, there is the same improvement as the twentieth preferred embodiment.

In a thirty-eighth preferred embodiment as an improvement on the broad invention, there is the same improvement as the twenty-third preferred embodiment.

In a thirty-ninth preferred embodiment, as an improvement on the above-described sixth preferred embodiment, the at-least one closure member includes at-least one closure member through-space perforation, each closure member through-space performation having a predetermined maximum size sufficiently small to rein any one of said metal, plastic and ceramic elements within the globally-shaped inner space.

In a fortieth preferred embodiment, as an improvement on the above-described thirty-ninth preferred embodiment, there is the same improvement as described in the thirty-ninth preferred embodiment.

The invention may be better understood by making reference to the following Figures.

THE FIGURES

Each of the following Figures is not intended to represent exact dimensions unless otherwise stated hereinafter, but is intended to be symbolically and diagrammatically representative of particular features of the broad and preferred embodiments.

FIG. 1A symbolically and diagrammatically illustrates in exploded view the combination of the spherical globe-forming structure, the perforated male closure member 14 and the intermediate O-ring in a side perspective view.

FIG. 1B symbolically and diagrammatically illustrates an alternate non-perforated male closure member for the same combination of FIG. 1A to be intermittently substituted for perforated male closure member, also illustrated in side perspective view.

FIG. 2 symbolically and diagrammatically illustrates in exploded view an alternate combination of a multisided sphere-forming structure and the non-perorated male closure structure **14*b*** shown in partial cut-away, together with the intermediate O-ring, shown in side perspective view.

FIG. 3 symbolically and diagrammatically illustrates in exploded view an alternate combination of a perforated multisided sphere-forming structure and the non-perforated male closure structure, shown in side perspective view.

FIG. 4 symbolically and diagramatically illustrates in side cross-sectional view, the globe-forming structure with is mated male closure member in combination with the contents of water media having therein abrasive and elememts being treated, within sealed inner space.

FIG. 4A illustrates an enlarged part-view of the FIG. 4, showing the threads, overhang and the O-ring.

FIG. 5A–C diagrammatically and symbolically illustrates a plurality of the combinations of mated globe-forming structure and male closure members, in side perspective view, with each thereof carrying a different indicia.

DETAILED DESCRIPTION

Figure 2:
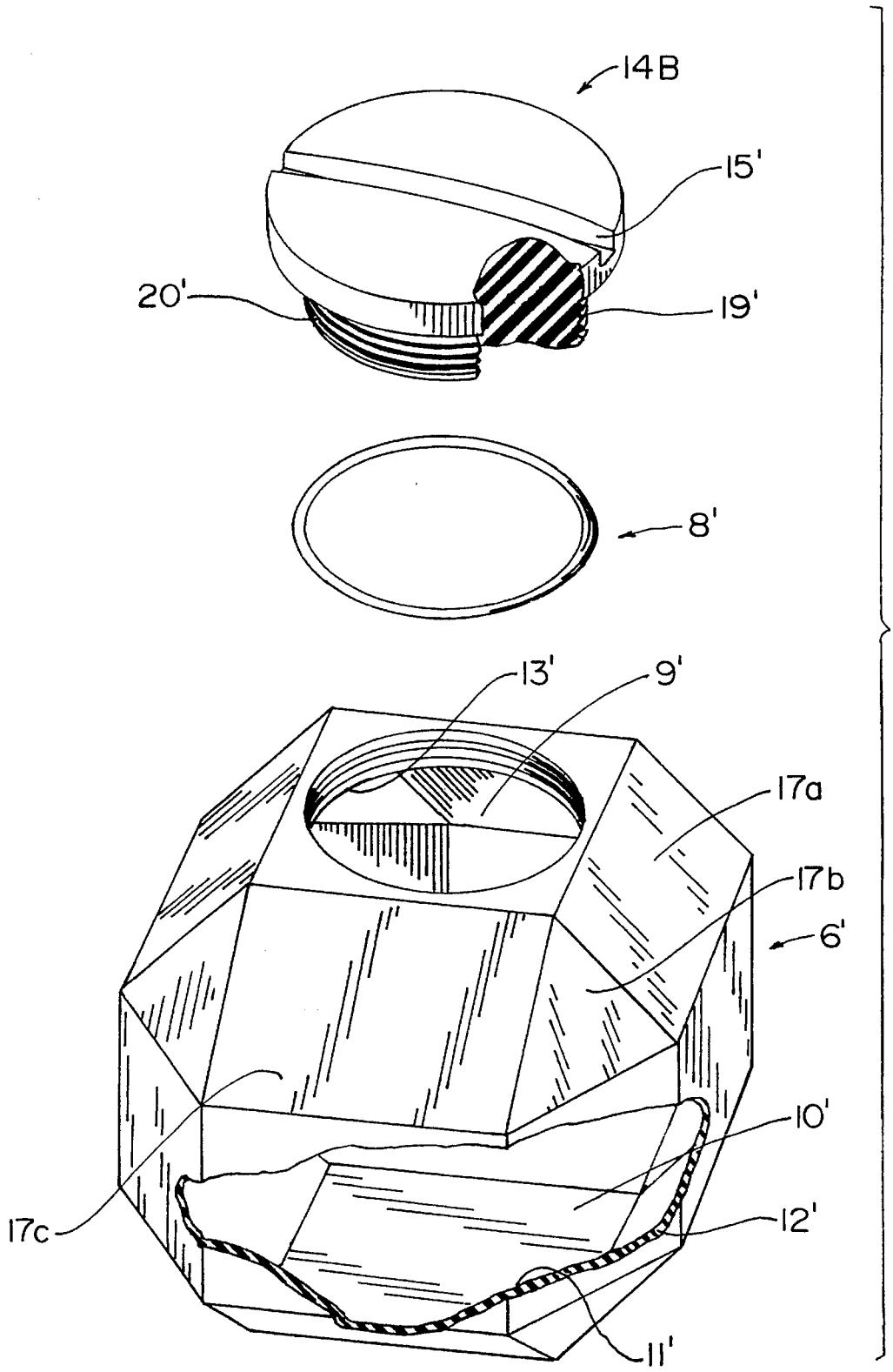

Apart from foregoing statements, the present inventor in his own business found need for a unit and/or combination unit for treatment(s) of diverse sizes and types of microsized lots of elements, in the burnishing and/or polishing thereof—also including one or more of deburring, polishing and/or other surface preparation of one or more of metal, plastic and/or ceramic (such as glass, etc.) elements and/or lots thereof. The invention achieves the ability to not only treat what might be characterized as conventional micro-sized elements or lots thereof, but also equally applicable to lots of very, very almost microscopically-sized elements requiring analagous treatment and handling before and after treatment, where avoiding loss has heretofore constituted a formidable problem, apart from separation thereof from other elements and/or from abrasives, abrasive dust, carrier media and the like. While the vibrations and/or centrifugal motions of the massively large industrial type vibratory tumbling machine for its tray (or the like) containing the primary large-sized elements being treated thereby, imparts it vibration(s) and centrifugal motions to and through the sphere wall of the present inventive unit(s) of the present invention, additionally the degree to which such is imparted, i.e. the amplitude imparted in the spherical inner-space treatment to the; microsized elements also depends upon the amount and nature of the abrasive(s) and/or media (if any) and nature of any media present within the spherical inner-space. Also, the degree of hardness and/or shape and/or size of the abrasive(s) likewise determines the type and degree of treatment of particular microsized elements within a particular sphere unit of the present invention.

The aforestated embodiment inclusive of the O-ring seal to the male portion beneath the overhang of the male member, provides total sealing off of the contents of the inner-space aforestated, such that therewith it is possible to conventionally tumble larger parts in liquid and media bath, while at the same time dry tumbling and polishing small parts (elements or lots thereof). While broadly the invention includes either smooth arcuate and/or curved surface(s) to the inner walls defining the inner space, and/or the multi-sided inside face—having a plurality of separate interconnected "flats" (such as a barrel type tumbler), that improvement achieves the lifting of the parts and media (inside the sphere's inner space) off of the bottom such as in the process of rotary barrel tumbling. This type of burnishing action is known as "slide zone action". At the same time, a constant frictional engagement of media and parts is taking place as well as a result of the vibratory action. The end result is a much more efficient and effective tumbling action that takes place for either the burnishing, deburring, or other types of surface preparation achieved in this type of fininshing process by the larger industrial units for conventional larger industrial vibratory tumbling machines aforestated.

By utilizing the present invention in one or more variations and improvements thereof, a real time saving is achievable for any manufacturing company involved in that tipe of vibratory de-burring, polishing, etc., of the parts they either make for their customers and/or for themselves for use in their own product. The present inventive spheres may also be utilized, as need might make desirable, to place larger element(s) thereoin, restricted solely by the particular size of the closure opening—which may range up to half the size of the inner sphere space's diameter. The utilization above-noted of a plurality of such inventive unites (spheres), with each thereof having a different identifying number, letter, color or the like, or combination(s) thereof, with record keeping as to which elements go into the particularly identified unit(s), make possible the concurrent treatments of several different separate and isolated different lots, and which identification and recovery after treatment in accord with the recorded information, such plurality also affording for different lots of different elements, the use of different abrasive(s) and/or hardness thereof and/or media such a water (typically and usually). For situations where the microsized element-unit is using the same media and/or abrasive (s), as above-stated there may be apertures having sizes smaller than the microsized elements in the inner-space, such that the con, non media or the like also flows within the sphere's inner space. A particular practical limitation in the use of the present invention is the self-evident limitation of the sealed unit (having sealed inner-space), that that the total volume of contents may not exceed about seventy-five percent (75%) more or less, in order that efficient vibratory tumbling and/or slide zone action will take place. Also, as above-stated, variations in degree of treatment depend upon the actual amount (in total) of all contents, present with the inner space of a sealed united—having the closure member—for both the emboidiment with or without the sealing O-ring.

Thus, the present inventive unit(s) greatly enhance(s) the current use of the typically conventional large industrial-sized tumbling machines, by expandiong their usage in such a way as to make small part(s) (micro-sized elememt (s)) and/or small lot (s) tumbling more efficient, versatile and time and cost effective.

A self-contained abrasion-resistant plastic (or like material) hollow sphere of the present invention, is loaded through an entry port with abrasive, cleaning or polishing media along with the elements to be burnished, etc. The sphere is then sealed closed with a screw on or latch type cover which is itself sealed with an "o"-ring. The sphere and its contents are then placed into theslurry of media in an existing vibratory tumbler. In response to the vibrations from the tumbler, the media within the tumbler will orbit in a circular path. This movement in turn causes the sphere and its contents to vibrate and rotate, thus creating a nsecond orbit of the contents within the sphere. The sphere is now a freely orbiting and dependent, yet independent, member of the contents of the vibratory tumbler. A plurality of pheres can be freely dispersed within the vibratory tumbler bowl, each sphere containing possibly a different type of element and/or burnishing media to be tumbled.

Another possibility is a dry polishing combination which requires no liquid to enter the sphere. Vibratory de-burring and finishing of may individual lots, with each using a different type of media, can be carried out simultaneously in one vibratory tumbler with the use of individual spheres. This could also be in conjunction with whatever was simultaneously being tumbled in the main bowl of the tumbler without any interference or disruption from the presence of the spheres in the main slurry within the vibratory tumbler bowl.

The vibratory action and seocnd orbit of the contents within the sphere can be further enhanced changing the shape of the inside wall surface of the sphere (from a radious-mirroring a smooth, round globe shaped sphere) to having segmented flat surface(s) of a geodesic dome, or that of a barrel type tumbler, except still spherical in its general theme and aforestated advantages of that spherical shape. This multisided inner surface, because of the flat areas, lifts the contents up along the inside surface of the sphere and thus causes a slow rolling action to occure—known as a slide zone action, this happening as the sphere rotates in the main machines slurry of the vibratory and/or centrifugal tumbler. All the while, vibratory burnishing action on the second-orbit within the sphere takes place as well. Thus, a dual action occurs—vibratory action as well as barrel type tumbling. This double action can further increase the effectiveness of traditional vibratory tumbling, epeciallyh for parts of very small size(es), because no part of the contents of the sphere would be able to just remain on the bottom surface, as the bottom surface will be constantly changing in pitch due to the rolling action of the sphere.

Upon the completion of the tumbling cycle, the sphere is removed from the bowl of the vibratory tumbler. The sealed lid is removed and the contents are now exposed. Prior to emptying the contents of the sphere, a perforated secondary lid is attached to allow all internally held liquid to drain. The seconary lid is mainly used as an aid to the post-process cleaning of the contents of the sphere.

A further option on the globe-forming sphere's wall structure would be a performated wall/wall structure, similar to a cage or screen. The overall shape of the sphere(s) remain the same, either round, smooth, eliptical and/or geodesic or the like, with the multiple flats serving to facilitate the tumbling actions stated previously. However utilizing the perforated wall structure, the units would no longer be sealed in an air-tight manner, being solely sealed or closed sufficiently to retain contents therein, not atmosphere. The function of the cage effect is to allow the liquids and/or small burnishing elements and the like, to enter the sphere and filter through any or all openings, while retaining its elements being treated within the sphere.

Thus, from prior statements, the term "sealed" with regard to use of the O-ring use as a sealing gasket, relates to sealing media and/or other contents within the sphere inner space of a non-porous wall structure, apart and segreated totally from exterial media, or alternately sealing the lack thereof as compared to presence thereof outside the sphere. However, devoid of the O-ring, the term "sealed" still means the isolation of non-liquid or non-flowing elements being treated within the sphere(s)'s inner space, away from and apart from non-media abrasives and/or elements or the like, etc. exterior to the sphere(s).

Moreover, as noted above with regard to the unlimited size of the female closure opening, the sphere may be two substantially equal halves inclusive of opposing male and female threads that when mated lock the halves together. Likewise, for other equivalent joining elements.

Typically, the spheres of the present invention are injection molded around typically a cylinder which than is withdrawn and inner material thereafter machined-out to achieve the desired and extent of sphere inner-space. However, other methods of manufacture may be utilized.

Typical medias conventionally utilized within the spheres, if not dry, include (but are not limited to) water and/or detergent.

The use of liquid media within the closed sphere and/or perforated sphere, assists to suspend the grit and/or ground abrasive and/or waste abraded scraps.

The substantially spherical unit, and/or variation thereon such as the multisided inside and/or outside surface(s) thereof—typically referred to as 3-D polygon, are preferably made form polypropylene (as previolusly noted), and for this type composition (or any other equivalent copolymer or other polymer) the sphere and/or multiple sided embodiment may be made by joining-together two or more portions thereof, typically conventionally by use of hot wax sealant and/or epoxy and/or by ultrasoning welding, or as aforestated may be or include reaming-out thereof.

While not limited thereto, the O-ring typically and normally is composed of any appropriate sealing material—such as commercially available rubber product known as NOEPREME (Trademark).

Typically commercial industrial large-sized vibratory tumbling machine(s) is/or made and/or sold by ALMCO INC. of Albert Lea, Minn., including round round bowl vibratory machine(s). Another conventional typical commercial industrial large-sized vibratory tumbling machine(s) is the Model VE-200 standard unit advertised for deburring, descaling, polishing, cleaning, honing and radiusing.

Toto-Finish company is located in Kalamazoo, Mich., as another source o vibratory finishing equipment, proscesses and supplies, including typically a round ROTO-MAX Centrifugal finishing machine, and another machin—MULTI-PASS SPIRATION ER SEries machine, and another—SPIRATION EXTENDED RANGE SERIES, and another SPIRATION LONG RADIOUS MACHINE, and the like, advertised for deburring, burnishing drying, polishing, washing/cleaning, suface finishing, preplate finishing, radiusing, and the like. Another typical company is NIPPON DIA INDUSTRY CO., LTD, located in Tokyo, Japan, typically promoting the Centrifugal Finishing Machine Model DS8, as a surface mass parts finishing systems manufacturer and supplier, with also other models for different specialties.

Conventional abrasive tunneling media of numerous and diverse shapes for achieving different conventional results, are produced, advertised and sold as tumbling media by SWECO, Inc. a subsidiary of Emerson Electric Co., Sweco Inc. being located in Florence, Ky, having different media for different desired results—such as FB Media for very fine burnishing—containing no abrasive, and another identified as F media—for light deburring and burnishing, and another known as C Media—for cutting or burnishing, and another known as XC Media—for aggressive cutting, and another known as SC Media—designated as especially suited for materials to be welded, brazed or soldered, and another known as H Media—for super fast cutting.

Typical but not all-inclusive examples of elements that can be and are intended to be "treated" by the vibratory vessel of the present invention as described above, include the following.

a) Machining and metal working field: stampings, forgins, castings, turned parts, milled parts, ground parts, screw machined parts, formed parts, drawin parts, and gears;

b) Types of Industries using parts that need vibration tumbling treatment: aircraft components, aerospace components, medical components, connectors industry, fastener, electrical industry, eyelet industry, bearings industry, pump components, hydraulics components, automotive components, optics industry, lazer industry components for any type of machinery and communications industry.

The foregoing Figures may be better understood by the following description.

FIG. 1A symbolically and diagrammatically illustrates in exploded view the combination 5 of the spherical globe-forming structure 6, the perforated male closure member 14 and the intermediate O-ring 8 with its central through-space 7, all in a side perspective view. The spherical globe-forming structure 6 has a female threaded female closure opening 9 to spherical inner space 10, having the female threads 13. The spherical globe-forming structure 6 has its wall structure 12 with its inner surface 11*a* and its outer surface 11*b*. The male closure member 14 has a slot 15 in which a screw driver or other equivalent substantially flat-ended member may be intermittently fit to tighten or loosen the male closure member to and from its tightly screwed mounted state of its male threads 20 within the female threads 13, when the seal 8 circumscribes the upper portions of the threads 20. The male-threaded closure member 14 has an overhang 19 above the O-ring when mounted, overhanging the male threads 20. The male closure member 14 is perforated, typically for use after utilizing the male closure of FIG. 1B during treatment of elements to be burnished, cleansed or the like, lastly utilizing the male closure member 14 such that media and dust carried thereby may be drained from the inner since 10, prior to removing the substitute male closure member 14. After removal of the male closure member 14, the contents are then thereafter separated into the cleansed and/or burnished, etc. elements, apart from abrasives.

FIG. 1B symbolically and diagrammatically illustrates an alternate non-perforated male closure member 14A for the same combination of FIG. 1A to be intermittently substituted for perforated male closure member 14, also in side perspective view. As above noted, this is the male closure member utilized during the burnishing or the like, in its screwed-in sealed state within the female threads 13*a* of FIG. 1A.

FIG. 2 symbolically and diagranatically illustrates in exploded view an alternate combination of a multisided sphere-forming structure 6' and the non-perforated male closure structure 14*b* shown in partial cut-away, together with the intermediate O-ring 8', shown in side perspective view. This embodiment is basically the same as that of FIG. 1, apart from -the sphere-forming structure 6' being a multisided structure with both interior multisided wall-flats such as 10' and exterior multisided wall-flats 17*a*, 17*b*, 17*c* and the like. Also, in this Figure, the male closure member illustrates in partial cross-section the overhang 19'.

Figure 3:
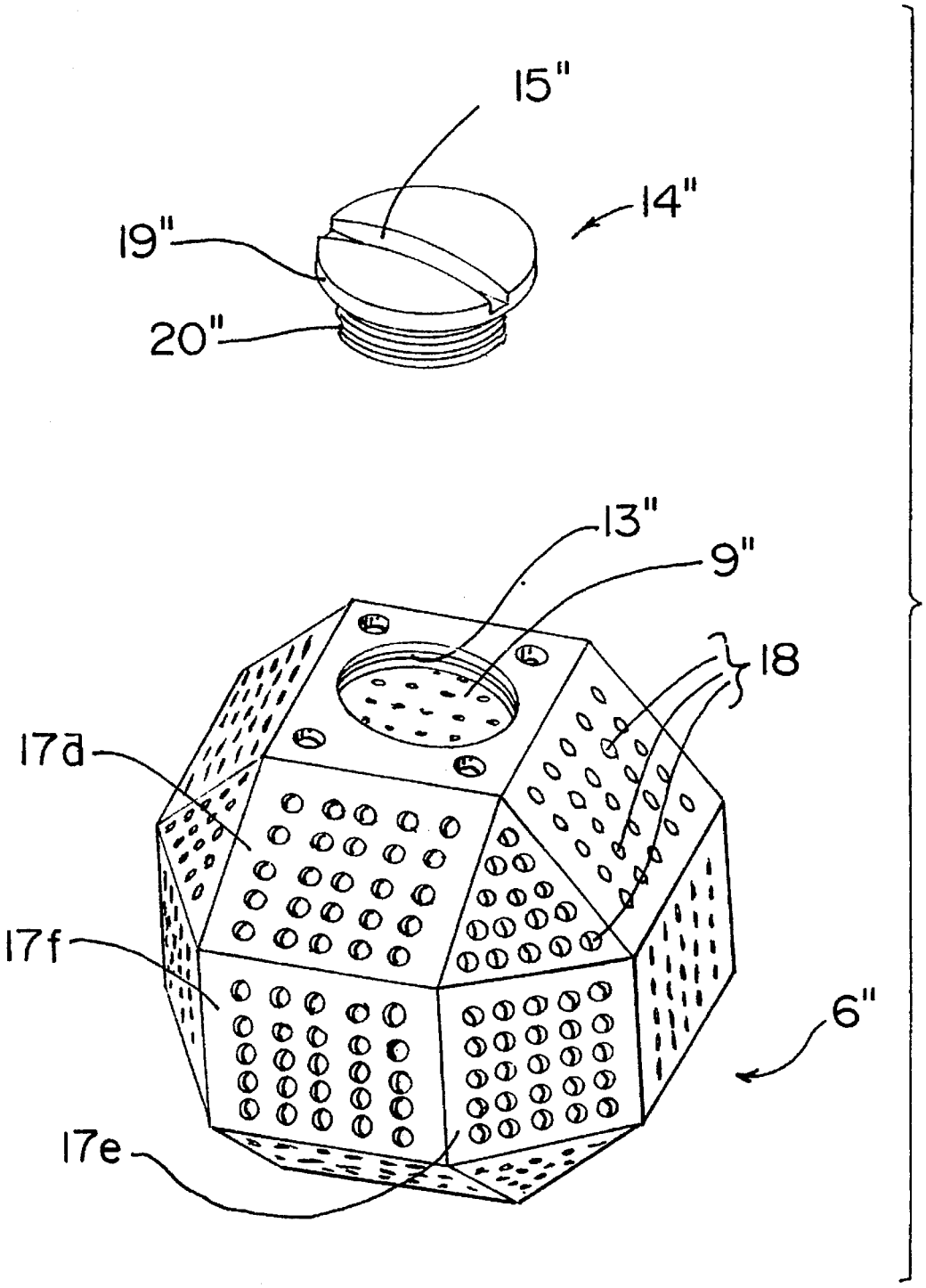

FIG. 3 symbolically and diagrammatically illustrates in exploded view an alternate combination of a perforated multisided sphere-forming structure 6" and the non-perforated male closure structure 14', shown in side perspective view. Thus also shown are the plurality of through-space perforations, through which during use, media being used by aforestated a typically conventional vibratory tumbling and/or centrifugal machine is shared, the shared media circulating into and through the through-space perforations into and out of inner space (such as that identified in prior figures) of the sphere-forming structure 6", this embodiment (as illustrated) also having the inner and outer plurality of flats for both inner and outer surfaces. It is also within the scope and spirit of the invention, that for appropriate analagous situations, the non-multisided embodiment of FIG. 1A may also have through-space perforations through the walls of the sphere-forming structure 6 and/or walls of the FIG. 4 sphere-forming structure 6A.

Figure 4:
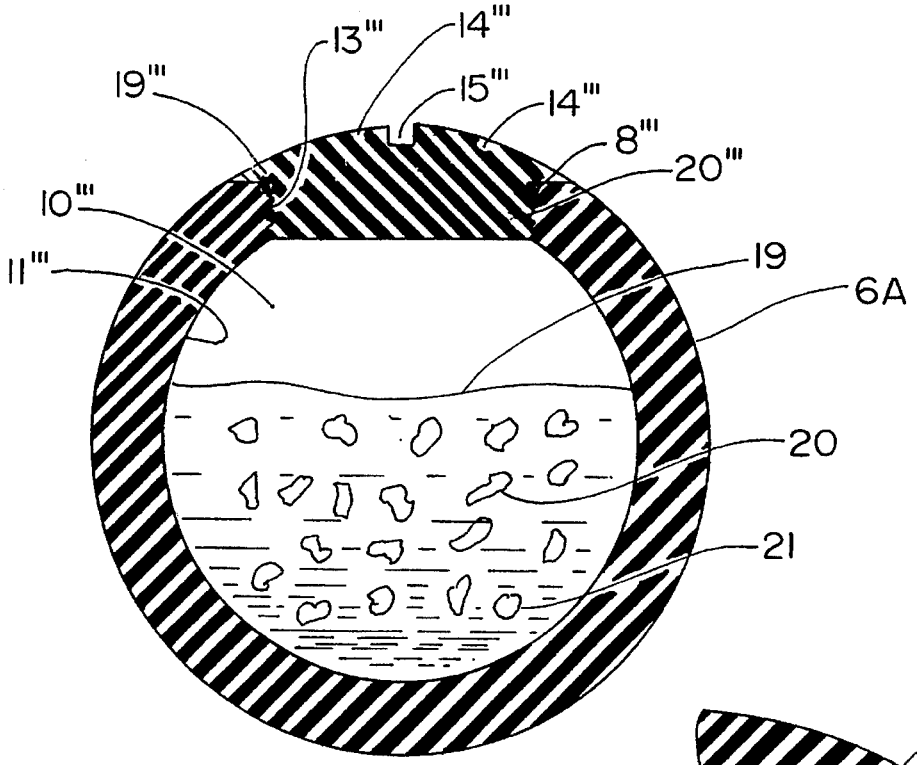

FIG. 4 symbolically and diagramatically illustrates in side cross-sectional view, the globe-forming structure 6A with is mated male closure member 14'" in combination with the contents of water media 19 having therein abrasive and elememts being treated, within sealed inner space. FIG. 4 also illustrates a typical level to which the inner space 10' has been filed during treatment. While solely a sparse number of elements and of abrasives are here illustrated, typically there are a crowded and large number of each within media. As well, while media (here typically water) 19 is herein illustrated, it is within the scope of the invention to omit in other embodiments the presence of any media—that often being the situation and way of operation for many conventional well known treatments.

Figure 4A:
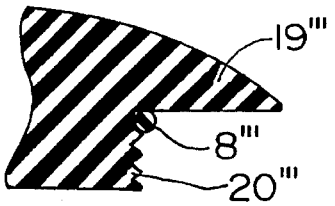

FIG. 4A—as an enlarged in-part view of FIG. 4, illustrates the O-ring 8'" in place at the top of the male threads 20'" below the overhang'".

Figure 5:
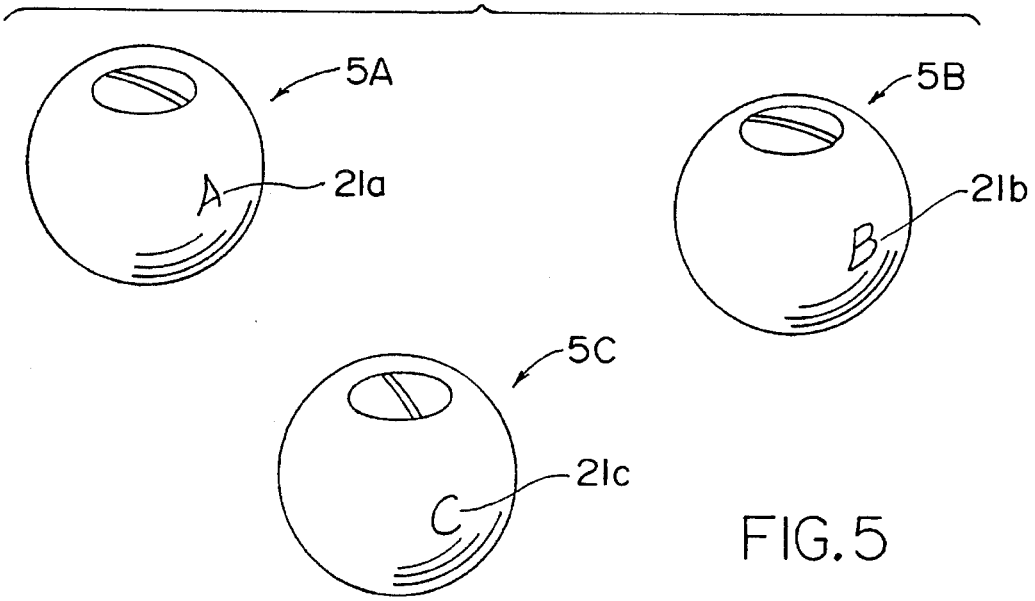

FIG. 5 diagrammatically and symbolically illustrates a plurality of the combinations of mated globe-forming structure and male closure members, in side perspective view, with each thereof carrying a different indicia 21*a*, 21*b* and 21*c*. The indicia may be (as shown) different letters such as the "A" for 21*a*, "B" for 21*b* and "C", for 21*c*—and/or alternatively may being different colors such as the "A" sphere being red, the "B" sphere being blue" and the "S" sphere being white, or the like, and/or numerals may be used, or other "marks" easily differentiateable from one-another.

It should be noted that while the present invention and its various embodiments in preferred embodiments thereof as previously described, include one or more different abrasive, sometimes with media, sometimes without media, the present invention does not amount to nor include novel burnishing and/or cleaning agents or the like, apart from the benefits of utilizing the prior art conventional forms thereof as novel combination (s) with the present structures described above, with resulting new and unexpected and beneficial results. Otherwise, the present invention utilizes conventional and notoreiously well know burnishing, and cleansing agents and other treatments above-discused, as a part of and in conjunction with the present invention.

It is within the scope of the present invention to make such variations and modifications and substitution of equivalents as would be apparent to a person of ordinary skill in this art.

I claim:

1. A vibratory vessel for use conjunction with a vibratory tumbling machine utilizing a burnishing or cleansing media, for burnishing or cleansing metal, plastic and ceramic elements comprising in combination: a substantially globe-forming structure having a substantially globally-shaped exterior surface and having an inner wall surface forming a globally-shaped inner space separate and apart from outer space exterior to said globe-forming structure, said substantially globe-forming structure having at-least one female closure opening-forming structure forming at-least one female closure-opening therein, said substantially globe-forming structure being wall structure of at least one of a plastic; and at-least one male closure member of a shape effective to sealably close said female closure-opening, said at-least one female closure opening-forming structure and said at-least one closure member being jointly and coordinately structured such that said at-least one of said female closure opening-forming structure is intermittently mountable within said at-least one female closure-opening, said substantially continuous wall structure being retainable of at-least one of metal, plastic and ceramic elements within said globally-shaped inner space, said female closure-opening being of a first predetermined size sufficiently large for passage therethrough at-least one of metal, plastic and ceramic elements within said globally-shaped inner space, said substantially continuous wall structure includes a plurality of small aperture extending between and through said substantially globally-shaped exterior surface and having an inner wall surface, each of said plurality of small apertures being of a predetermined maximum size sufficiently small to retain at-least one of metal, plastic and ceramic elements within said globally-shaped inner space.

2. The vibratory vessel of claim 1, in which said substantially continuous wall-structure has inner walls forming said globally-shaped inner space, and said composition is of a predetermined hardness sufficient that said inner walls are substantially abrasive-resistant to abrasive action of a burnishing composition adapted to burnish at-least one of said metal, plastic and ceramic elements when a burnishing composition is jointly enclosed within said global inner space with said at-least one of said metal, plastic and ceramic elements.

3. The vibratory vessel of claim 2, in which said wall composition consists essentially of predominantly polypropylene.

4. The vibratory vessel of claim 2, in which said wall composition consists essentially of predominantly a polypropylene copolymer.

5. The vibratory vessel of claim 2, in which said wall composition consists essentially of predominantly natural rubber.

6. The vibratory vessel of claim 2, in which said wall composition consists essentially of predominantly a synthetic rubber.

7. The vibratory vessel of claim 3, in which said the at-least one closure member includes a male threaded structure, and in which the at-least one female opening-forming structure includes a female-threaded structure, said male threaded structure being sealably mateable with said female threaded structure.

8. The vibratory vessel of claim 7, in which said substantially globally-shaped exterior surface is substantially spherical in shape.

9. The vibratory vessel of claim 8, in which said inner wall surface is substantially spherical in shape.

10. The vibratory vessel of claim 7, in which said substantially globally-shaped exterior surface is substantially multisided in shape.

11. The vibratory vessel of claim 10, in which said inner wall surface is substantially multisided in shape.

12. The vibratory vessel of claim 11, in which each of both of said globally-shaped exterior surface and said inner wall surface, is polygonal in shape.

13. The vibratory vessel of claim 1, in which said substantially continuous wall structure includes a plurality of small apertures extending between and through said substantially globally-shaped exterior surface and having an inner wall surface, each of said plurality of small apertures being of a predetermined maximum size sufficiently small to retain said metal elements within said globally-shaped inner space.

14. The vibratory vessel of claim 1, in which said substantially continuous wall structure includes a plurality of small apertures extending between and through said substantially globally-shaped exterior surface and having an inner wall surface, each off said plurality of small apertures being of a predetermined maximum size sufficiently small to retain said plastic elements within said globally-shaped inner space.

15. The vibratory vessel of claim 1, in which said substantially continuous wall structure includes a plurality of small apertures extending between and through said substantially globally-shaped exterior surface and having an inner wall surface, each of said plurality of small apertures being of a predetermined maximum size sufficiently small to retain said ceramic elements within said globally-shaped inner space.

16. The vibratory vessel of claim 1, in which said at-least one closure member includes a lip structure overhanging said male threaded structure, and including a sealing ring mounted around said male threaded structure when said male threaded structure is sealably mounted in said female threaded structure.

17. The vibratory vessel of claim 12, in which said at-least one closure member includes a lip structure overhanging said male threaded structure, and including a sealing ring mounted around said male threaded structure when said male threaded structure is sealably mounted in said female threaded structure.

18. The vibratory vessel of claim 12, including a plurality of the substantially globe-forming structure and of the at-least one male closure member, each of said plurality having a different visibly discernibly recognizable identity thereon different from identities of remaining others of said plurality.

19. The vibratory vessel of claim 18, in which the visibly discernibly recognizable identity is a color marking, such that each of the plurality has a different color marking as compared to a remainder of others of said plurality.

20. The vibratory vessel of claim 12, including abrasive elements within said globally-shaped inner space, said abrasive elements being of a second predetermined size sufficiently small for passage through said female closure-opening.

21. The vibratory vessel of claim 12, in which said abrasive elements includes predominantly at-least one of plastic elements, ceramic elements, crushed walnut shells, corn cob dust, steel shot and stone aggregates.

22. The vibratory vessel of claim 12, in which said abrasive material includes predominantly plastic elements.

23. The vibratory vessel of claim 12, including suspension media at-least partially suspendable of at-least one of said abrasive material and said metal, plastic and ceramic elements within said globally-shaped inner space when said substantially globe-forming structure with said at-least one male closure member sealably mounted within said at-least one female closure-opening, is tumbled by a vibratory tumbling machine.

24. The vibratory vessel of claim 1, in which said the at-least one closure member includes a male threaded structure, and in which the at-least one female opening-forming structure includes a female-threaded structure, said male threaded structure being sealably mateable with said female threaded structure.

25. The vibratory vessel of claim 1, in which said substantially globally-shaped exterior surface is substantially spherical in shape.

26. The vibratory vessel of claim 1, in which said inner wall surface is substantially spherical in shape.

27. The vibratory vessel of claim 1, in which said substantially globally-shaped exterior surface is substantially multisided in shape.

28. The vibratory vessel of claim 1, in which said inner wall surface is substantially multisided in shape.

29. The vibratory vessel of claim 1, in which each of both of said globally-shaped exterior surface and said inner wall surface, is polygonal in shape.

30. The vibratory vessel of claim 1, in which said at-least one closure member includes a lip structure overhanging said male threaded structure, and including a sealing ring mounted around said male threaded structure when said male threaded structure is sealably mounted in said female threaded structure.

31. The vibratory vessel of claim 1, in which the visibly discernibly recognizable identity is a color marking, such that each of the plurality has a different color marking as compared to a remainder of others of said plurality

32. The vibratory vessel of claim 1, in which said at-least one closure member includes at-least one closure member through-space perforation, each through-space performation having a predetermined maximum size sufficiently small to retain any one of said metal, plastic and ceramic elements within said globally-shaped inner space.

33. A vibratory vessel for use in conjunction with a vibratory tumbling machine utilizing a burnishing or cleansing media, for burnishing or cleansing metal, plastic and ceramic elements comprising in combination: a substantially globe-forming structure having a substantially globally-shaped exterior surface and having an inner wall surface forming a globally-shaped inner space separate and apart from outer space exterior to said globe-forming structure, said substantially globe-forming structure having at-least one female closure opening-forming structure forming at-least one female closure-opening therein, said substantially globe-forming structure being wall structure of at least one of a plastic; and at-least one male closure member of a shape effective to sealably close said female closure-opening, said at-least one female closure opening-forming structure and said at-least one closure member being jointly and coordinately structured such that said at-least one of said female closure opening-forming structure is intermittently mountable within said at-least one female closure-opening, said substantially continuous wall structure being retainable of at-least one of metal, plastic and ceramic elements within said globally-shaped inner space, said female closure-opening being of a first predetermined size sufficiently large for passage therethrough at-least one of metal, plastic and ceramic elements within said globally-shaped inner space, including abrasive elements within said globally-shaped inner space, said abrasive elements being of a second predetermined size sufficiently small for passage through said female closure-opening.

34. A vibratory vessel for use in conjunction with a vibratory tumbling machine utilizing a burnishing or cleansing media, for burnishing or cleansing metal, plastic and ceramic elements comprising in combination: a substantially globe-forming structure having a substantially globally-shaped exterior surface and having an inner wall surface forming a globally-shaped inner space separate and apart from outer space exterior to said globe-forming structure, said substantially globe-forming structure having at-least one female closure opening-forming structure forming at-least one female closure-opening therein, said substantially globe-forming structure being wall structure of at least one of a plastic; and at-least one male closure member of a shape effective to sealably close said female closure-opening said at-least one female closure opening-forming structure and said at-least one closure member being jointly and coordinately structured such that said at-least one of said female closure opening-forming structure is intermittently mountable within said at-least one female closure-opening, said substantially continuous wall structure being retainable of at-least one of metal, plastic and ceramic elements within said globally-shaped inner space, said female closure-opening being of a first predetermined size sufficiently large for passage therethrough at-least one of metal, plastic and ceramic elements within said globally-shaped inner space, including suspension media at-least partially suspendable of at-least one of said abrasive material and said metal, plastic and ceramic elements within said globally-shaped inner space when said substantially globe-forming structure with said at-least one male closure member sealably mounted within said at-least one female closure-opening, is tumbled by a vibratory tumbling machine.

* * * * *